United States Patent [19]

Sleamaker

[11] Patent Number: 5,029,848

[45] Date of Patent: Jul. 9, 1991

[54] EXERCISE MACHINE WITH ROLLER CARRIAGE MOUNTED ON MONORAIL

[76] Inventor: Robert H. Sleamaker, 372 Governor Chittenden Rd., Williston, Vt. 05495

[21] Appl. No.: 253,113

[22] Filed: Oct. 4, 1988

[51] Int. Cl.[5] ..... A63B 21/00

[52] U.S. Cl. ..... 272/120; 272/71

[58] Field of Search ..... 272/71, 97, 120, 93, 272/134, 116, 117, 121, 143, 144; 128/25 R; D21/195

[56] References Cited

U.S. PATENT DOCUMENTS

| | | | |
|---|---|---|---|
| D. 284,597 | 7/1986 | Smith et al. | 272/120 |
| 3,586,322 | 6/1971 | Kverneland | 272/ |
| 3,614,097 | 10/1971 | Blackman | 272/ |
| 3,658,327 | 4/1972 | Thiede | 272/ |
| 4,004,801 | 1/1977 | Campanaro et al. | 272/120 |
| 4,023,795 | 5/1977 | Pauls | 272/ |
| 4,176,836 | 2/1979 | Coyle | 272/120 |
| 4,383,684 | 5/1983 | Schliep | 272/120 |
| 4,434,981 | 3/1984 | Norton | 272/ |
| 4,659,077 | 4/1987 | Stropkay | 272/ |

OTHER PUBLICATIONS

Advertisement Precor 720, 1985.

Audi Brochure, p. 15.

*Primary Examiner*—Stephen R. Crow

*Attorney, Agent, or Firm*—Limbach, Limbach & Sutton

[57] ABSTRACT

An exercise machine has a front stanchion assembly and a rear stanchion assembly. An inclined monorail is mounted between the stanchion assemblies, and a roller carriage assembly having spool-shaped rollers, is mounted so as to receive the monorail, and roll upon it. The roller carriage is adapted so that a bicycle seat assembly (for use in cross country ski simulation) and a swim bench assembly may be interchangeably rigidly secured to the roller carriage assembly. The monorail may be attached to the front and rear stanchion using a telescoping sleeve to permit adjustment of the monorail orientation.

25 Claims, 3 Drawing Sheets

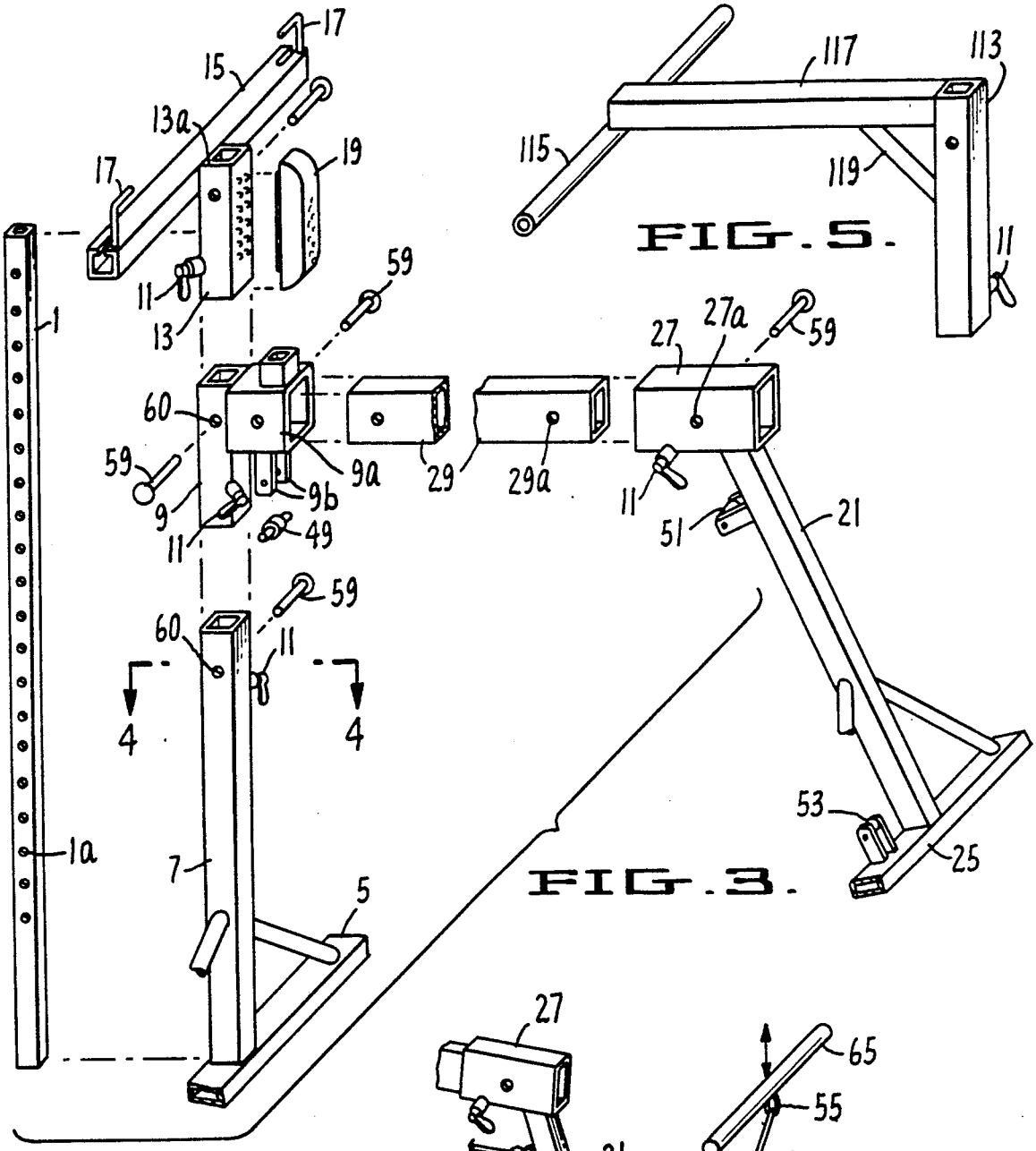
FIG. 3.
FIG. 5.
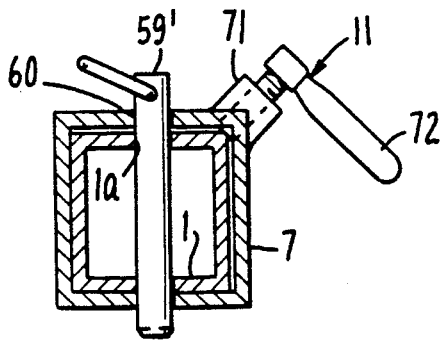
FIG. 4.
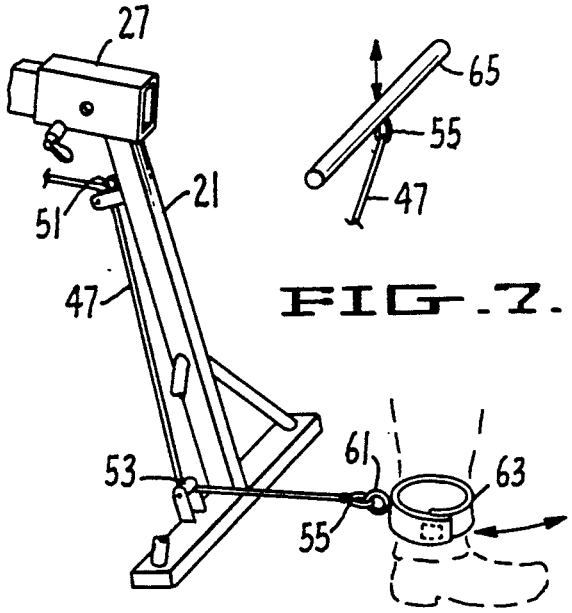
FIG. 6.
FIG. 7.

EXERCISE MACHINE WITH ROLLER CARRIAGE MOUNTED ON MONORAIL

TECHNICAL FIELD

The present invention relates generally to exercise machines. More specifically, the invention is an exercise machine employing a rolling carriage mounted on a monorail, for facilitating strength and endurance training by skiers, swimmers, and other persons.

BACKGROUND OF THE INVENTION

A variety of exercise machines are now available for providing cardiovascular and muscular development to athletes and other persons. These machines are particularly useful for skiers and other athletes preparing to participate in seasonal sports. Conventional exercise machines include weight lifting exercise units as described in U.S. Pat. No. 3,614,097, rowing machines as described in U.S. Pat. Nos. 3,586,322 and 4,004,801, and cross country ski exercisers such as those described in U.S. Pat. Nos. 4,023,795, 4,434,981, and 4,659,077.

Conventional exercise machines, however, do not specifically simulate the current poling techniques used in cross country skiing. For example, conventional ski exercisers are not designed to simulate a cross country skiing technique in which skiers move both their arms in unison to propel themselves forward with both poles simultaneously. On the other hand, conventional exercise machines that do allow a user, in a seated or prone position, to pull with both arms simultaneously have not been designed for use by standing users, and hence do not simulate skiing activity.

Further, conventional ski exercisers such as those described above simulate only a particular type of exercise activity (i.e., a skiing motion) and are not designed to accept interchangeable components that may be used to simulate other forms of athletic activity, such as swimming.

SUMMARY OF THE INVENTION

The present invention is an exercise machine, including a front stanchion assembly, which is preferably inclined at an angle substantially equal to 70 degrees from horizontal for enhanced stability, and a rear stanchion assembly, which is also preferably inclined for enhanced stability. A monorail is mounted between the stanchion assemblies at an incline, and a roller carriage is mounted so as to be capable of rolling along the monorail. A user supported by the roller carriage (in a standing position in a ski simulation embodiment) pulls on straps attached at one end to the front stanchion to roll the carriage up the inclined monorail. The carriage is preferably designed so that a bicycle seat (for use for skiing simulation) and a padded bench (on which the user may lie for swimming simulation) may be interchangeably mounted thereon.

Also in a preferred embodiment, a telescoping sleeve releasably connects the monorail to the front stanchion assembly, so that the point of attachment of the monorail relative to the front stanchion assembly may be readily adjusted.

Preferably, the inventive apparatus also includes a pulley-cable assembly which allows the user to perform a wide variety of exercises. In the pulley-cable assembly, one end of the cable is attached to the rolling carriage, and the cable is then looped through pulleys at the front and rear stanchions. The other end of the cable may be attached to an ankle strap (to allow the user to perform leg exercises), or to a handle bar (to allow the to perform arm exercises). The roller carriage is preferably designed so that weights may be readily attached to it so that the user may readily adjust the force that must be applied to the cable (i.e., the force applied to the ankle strap or handle bar) to translate the carriage.

BRIEF DESCRIPTION OF THE DRAWINGS

FIG. 3 is an exploded perspective view of a portion of the FIG. 1 embodiment of the invention.

FIG. 4 is a sectional view of the FIG. 3 assembly, along line 4—4 of FIG. 3.

FIG. 5 is a perspective view of a pull up bar assembly that may be attached to the front stanchion sleeve of FIG. 1.

FIG. 6 is a perspective view of a portion of the FIG. 1 embodiment, with an ankle strap attached to the pulley thereof.

FIG. 7 is a perspective view of a handle bar that may be attached to the pulley of the FIG. 1 embodiment.

DETAILED DESCRIPTION OF THE PREFERRED EMBODIMENTS

Figures 1, 2:
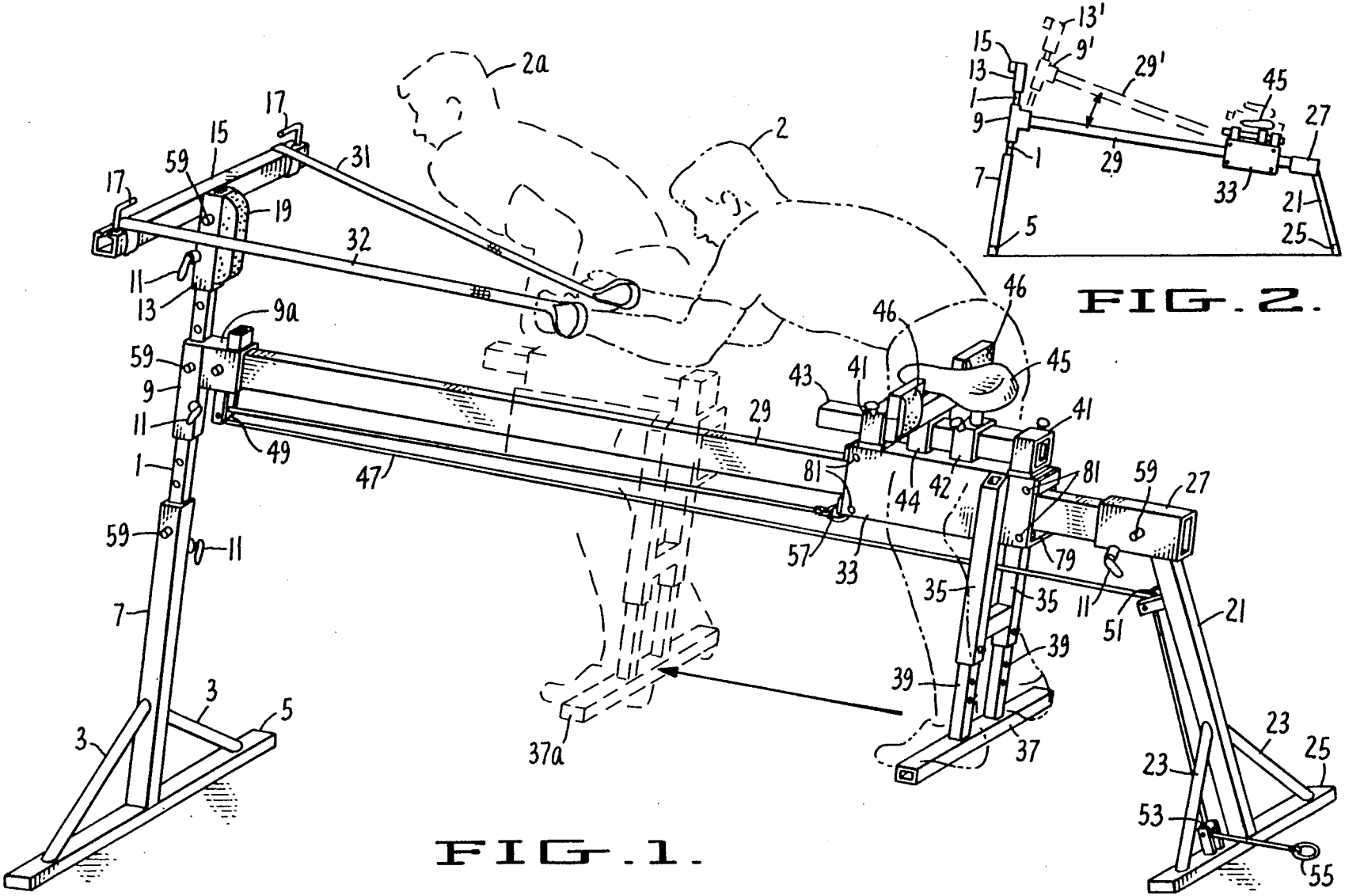
FIG. 1 is a perspective view of a preferred embodiment of the invention.
FIG. 2 is a side elevational view of a portion of an alternative embodiment of the invention.

A preferred embodiment of the invention will be described initially with reference to FIG. 1. The front stanchion includes front stanchion telescope tube 1, lower sleeve 7, central sleeve 9, and pull strap assembly sleeve 13. Tube 1 is dimensioned to be slidably mounted within sleeves 7, 9, and 13, and quick release members 11 and safety pins 59 (to be discussed below with reference to FIG. 3) are provided for releasably holding tube 1 in any selected one of several positions relative to sleeves 7, 9, and 13. Horizontal base 5 and supports 3 support sleeve 7 in a desired fixed orientation. Preferably, the longitudinal axis of sleeve 7 (and hence the longitudinal axis of tube 1) is inclined at an acute angle (preferably substantially equal to 70 degrees) relative to the horizontal plane on which base 5 rests. The inclined orientation of sleeve 7 and tube 1 enhances the stability of the inventive apparatus during operation.

In an alternative embodiment in which tube 1 is mounted against a vertical surface (such as a door or wall), lower sleeve 7, base 5, and supports 3 may be omitted. These omitted elements may be replaced by a bracket mounted against the vertical surface, with the bracket including a sleeve for receiving tube 1 and holding tube 1 in a desired inclined orientation. Alternatively, omitted elements 3, 5, and 7 may be replaced by a mounting assembly including one or more hanging straps, and a bracket supported by the straps. The upper end of each hanging strap is fastened to the vertical surface (for example, to the top of a door). The bracket is positioned against the vertical surface, and includes a sleeve for receiving tube 1 and holding tube 1 in a desired inclined orientation.

The pull strap sleeve assembly which includes sleeve 13 also includes upper crossbar member 15 and pad 19, both fixedly attached to sleeve 13. Pad 19 (which is preferably made of dense, shock-absorbing foam) is positioned to prevent user 2 seated on bicycle seat 45 from injuring his or her head in the event that the user's head approaches sleeve 13 as carriage 33 and seat 45 roll toward the left on monorail 29. Preferably, pad 19 is removably attached to sleeve 13, such as by velcro. Crossbar 15 is attached orthogonally to the common longitudinal axis of front stanchion tube 7 and sleeve 13. Each of pull straps 31 and 32 has an end fixedly attached adjacent an opposite end of crossbar 15. Pull strap retaining pins 17 extend outward from crossbar 15, to prevent straps 31 and 32 from sliding off the ends of crossbar 15.

Horizontal base 25 and supports 23 are fixedly attached to rear stanchion 21, so as to support rear stanchion 21 in a desired fixed orientation. Preferably, the longitudinal axis of stanchion 21 is inclined at an acute angle (preferably substantially equal to 70 degrees) relative to the horizontal plane on which base 25 rests, when the inventive apparatus is in operation. The inclined orientation of rear stanchion 25 enhances the stability of the inventive apparatus during operation (as does the inclined orientation of front stanchion tube 1).

Rear monorail support sleeve 27 is fixedly attached to the upper end of rear stanchion 25. Front stanchion sleeve 9 (which is adjustably attached around tube 1) includes a front monorail support sleeve portion 9*a*. Monorail 29 is attached in an inclined orientation between front support sleeve portion 9*a* and rear support sleeve 27. The front end of monorail 29 is positioned at a higher vertical elevation than is the rear end. Thus, if roller carriage 33 is allowed to roll freely along monorail 29, the force of gravity will cause carriage 33 to roll backward, toward rear support sleeve 27. Pins 59 and quick release assemblies 11 (to be described below with reference to FIG. 1) allow sleeve 27 and sleeve portion 9*a* to be rapidly connected to, and disconnected from, monorail 29.

Rollers 79 (best shown in FIG. 8) are mounted on axles 81 of roller carriage 33. Carriage 33 is free to translate along monorail 29 as rollers 79 roll along the upper and lower surfaces of the monorail. Interchange tube 43 is releasably attached to carriage 33 by interchange tube brackets 41. Brackets 41 are fixedly attached to carriage 33. Bicycle seat bracket 42 and thigh pad support bracket 44 are mounted along tube 43. Bicycle seat 45 is attached to bracket 42, and thigh support assembly 46 is attached to bracket 44.

Stirrup sleeves 35 attached to carriage 33 are dimensioned to receive two telescoping stirrup tubes 39. Horizontal stirrup 37 is fixedly attached to the lower ends of stirrup tubes 39. User 2 may assume a standing posture as he (or she) rests on seat 45, rests his (or her) feet on stirrup 37, and braces his (or her) thighs against the thigh supports of assembly 46. User 2 may then grip strap 31 with one hand and strap 32 with the other hand. As user 2 pulls on both straps simultaneously, the user's thighs will cause roller carriage 33 to roll forward and upward along inclined monorail 29 (for example, so that the user moves from position 2 to position 2*a*, and the stirrup moves from position 37 to 37*a*). Upon reaching position 2*a*, the user will cease to pull on straps 31 and 32 so that carriage 33 will freely roll back toward rear sleeve 27. In this way, the user (in a standing position) may repeatedly execute a skiing motion (simulating simultaneous manipulation of two ski poles), to develop endurance and upper body strength.

The FIG. 1 apparatus also includes pulley cable 47, and pulleys 49, 51, and 53. Pulley 49 is attached to monorail sleeve portion 9*a* of front sleeve 9, pulley 51 is attached to rear stanchion 21, and pulley 53 is attached to rear stanchion base 25. One end of cable 47 is attached to carriage 33 by ring 57. Cable 47 extends from ring 57 through pulleys 49, 51, and 53, and terminates at ring 55. Various exercise attachments (to be described below with reference to FIGS. 6 and 7) may be attached to ring 55. As ring 55 is pulled away from pulley 53, cable 47 pulls carriage 33 forward and upward toward front stanchion tube 1. Since energy must be expended to pull carriage 33 upward toward tube 1, the user may perform a variety of exercises (using various muscles) by pulling on ring 55. Weights may be attached to tube 43 of carriage 33, in a manner to be described in detail below with reference to FIG. 8.

In an alternative embodiment of the invention, pulley cable 47 and pulleys 49, 51, and 53 are omitted. FIG. 2 shows such an alternative embodiment. It should be understood that the FIG. 2 embodiment does include straps (such as straps 31 and 32) and a stirrup assembly (such as that including members 35, 37, and 39) but these are not shown in FIG. 2 for simplicity.

The height of sleeve 13 and the position of monorail 29 are adjustable in the same manner in both the FIG. 1 and 2 embodiments. The inclination angle of monorail 29 may be adjusted by freeing sleeve 9 so that it may slide along tube 1 (such as by removing pins 59 and loosening quick release 11 shown in FIG. 1), and then sliding sleeve 9 upward along tube 1 (for example, from position 9 to position 9' shown in phantom view in FIG. 2). The height of sleeve 13 may be adjusted by freeing sleeve 7 so that tube 1 may slide relative to sleeve 7 (such as by removing pins 59 and loosening quick release 11 shown in FIG. 1), and then sliding tube 1 upward with respect to sleeve 7 so that the entire assembly comprising tube 1 and sleeve 13 is raised (for example, so that sleeve 13 moves from position 13 to position 13' shown in phantom view in FIG. 2). Adjustment of sleeve 9 will rotate the rear stanchion assembly (including members 21, 23, 25, and 27) and front stanchion assembly (including members 1, 3, 5, 7, 9, and 13) relative to the horizontal surface on which they rest, so that the longitudinal axis of both front stanchion tube 1 and rear stanchion 21 will acquire a new inclination.

FIGS. 3 and 4 show in greater detail the manner in which the FIG. 1 apparatus may be readily assembled and disassembled. In order to reduce manufacturing costs, all the quick release assemblies 11 used in the inventive apparatus may be identical. Similarly, all the safety pins 59 may be identical. Safety pin 59' shown in FIG. 4 is shaped slightly differently than safety pins 59 shown in FIG. 3. Pins 59 and 59' (and other types of pins) may be used interchangeably in all embodiments of the invention.

To attach monorail 29 to sleeve 27, hole 29*a* extending through monorail 29 is aligned with hole 27*a* extending through sleeve 27, and pin 59 is inserted through both holes. Quick release assembly 11 is then tightened. Similarly, the other end of monorail 29 may be attached to sleeve 9.

Tube 1 may be attached to sleeve 7 in the same way. Tube 1 preferably has a plurality of holes arranged along its axis, as shown in FIG. 3. One of the holes extending through tube 1 (such as hole 1*a*) is aligned with hole 60 extending through sleeve 7, and safety pin 59 is inserted through the aligned holes. Quick release assembly 11 is then tightened.

FIG. 4 shows tube 1 and sleeve 7 in their assembled configuration. In FIG. 4, pin 59' extends through aligned holes la and 60. Quick release assembly 11 includes threaded housing 71 and screw portion 72. Housing 71 is fixedly attached to sleeve 7 around an orifice through sleeve 7. To lock members 1 and 7 together, the threads of screw 72 engage with the threads of housing 71 so as to advance screw 72 inward through the orifice into direct contact with tube 1. Screw 72 may be unscrewed (away from tube 1) to release tube 1 from sleeve 7.

The combination of a safety pin and quick release assembly shown in FIG. 4 may be employed at any of the adjustment points of the inventive system. Thus, each of sleeves 9 and 13 may be attached to tube 1 by a safety pin 59 and quick release assembly 11.

As shown in FIG. 3, pulley 49 is mounted between pulley supports 9*b*, which extend out from sleeve 9. Similarly, pulleys 51 and 53 are mounted between pairs of pulley supports extending outward from stanchion 21 and base 25, respectively.

FIG. 5 is a perspective view of a pull-up bar assembly including pull up bar 115, pull-up bar sleeve 113, support 117 connected between elements 113 and 115, and support 119 connected between elements 113 and 117. End 113*a* of sleeve 113 is dimensioned to fit around tube 1, so that sleeve 113 may be substituted for sleeve 13 at the upper end of tube 1 Alternatively, in an embodiment where tube 1 is sufficiently long so that it protrudes above upper end 13*a* of sleeve 13, both sleeves 13 and 113 may be attached to tube 1, with sleeve 113 above sleeve 13. Sleeve 113 is preferably locked in place around tube 1 by tightening quick release assembly 11, so that it may be disconnected from tube 1 after assembly 11 is loosened, when the pull-up bar assembly is attached to tube 1, pull-up bar 115 extends outward from the inventive apparatus in a position in which it may be grasped by a user to allow the user to perform pull-ups and other exercises.

In FIG. 6, ring 61 is attached to ring 55 at the rear end of pulley cable 47. Ankle strap 63 is attached to ring 61. Strap 63 may be fastened (for example, by velcro) around a user's ankle so that the user may cause cable 47 to pull carriage 33 up monorail 29, by pulling ankle strap 63 away from pulley 53.

In FIG. 7, cable ring 55 at the rear end of cable 47 is shown attached to handle bar 65. A user may exercise his or her arm muscles by pulling handle bar 65 away from pulley 53, thus causing cable 47 to pull carriage 33 up monorail 29.

Figures 8, 9, 10, 11:
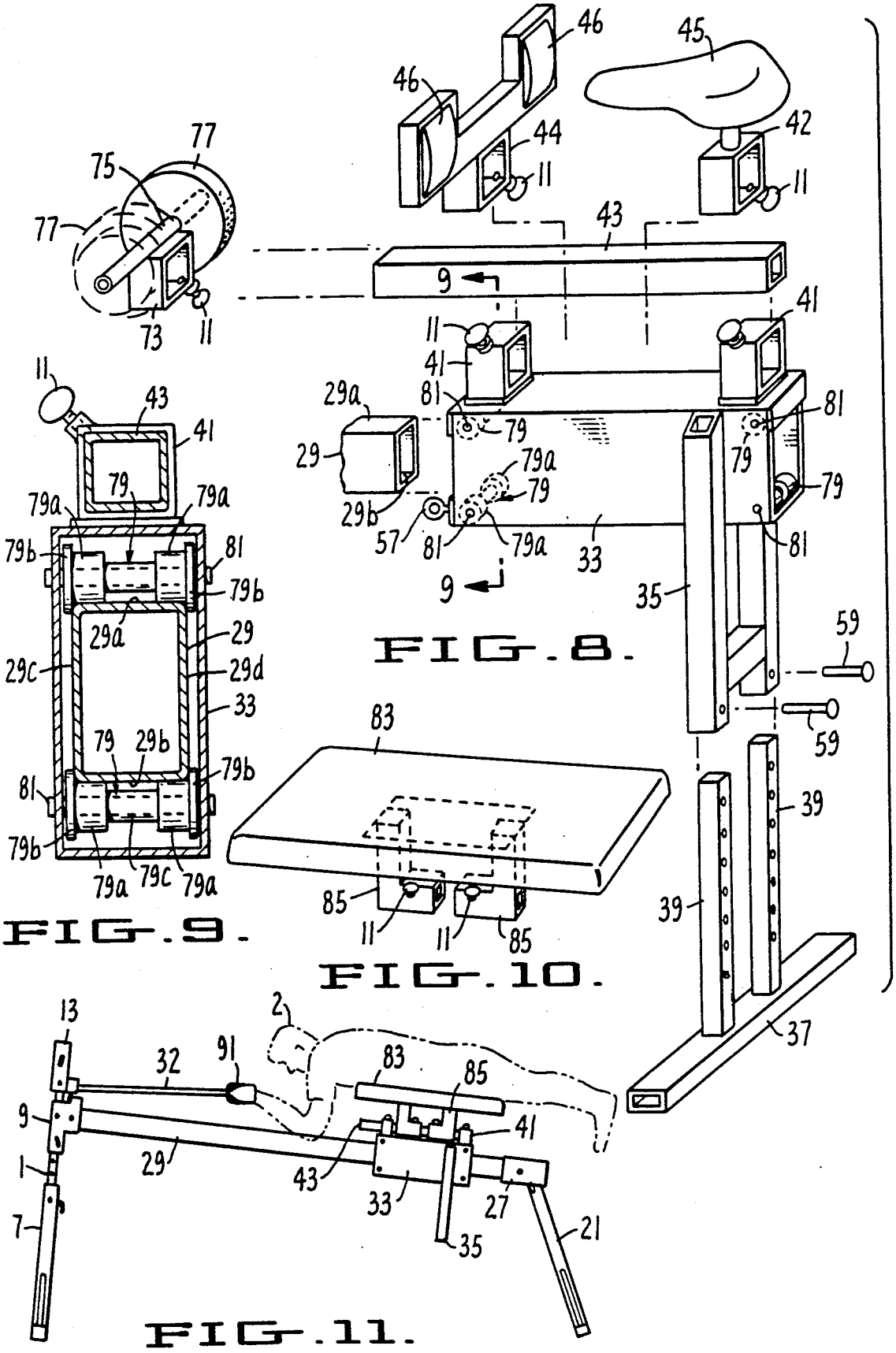
FIG. 8 is an exploded perspective view of a portion of the FIG. 1 embodiment of the invention.
FIG. 9 is a sectional view of the FIG. 8 assembly, along line 9—9 of FIG. 8.
FIG. 10 is a perspective view of a padded bench which may be substituted for the bicycle seat of the FIG. 1 embodiment of the invention.
FIG. 11 is a side elevational view of a portion the FIG. 1 embodiment of the invention in which a padded swim bench is substituted for the bicycle seat shown in FIG. 1.

In FIGS. 8 and 9, the details of the roller carriage assembly are clearly shown. Axles 81 are mounted within carriage 33, and a spool-shaped roller 79 is mounted on each axle 81. Rollers 79 and axles 81 are best shown in FIG. 9. Each roller 79 has a small diameter central portion, two intermediate-diameter outer portions 79*a*, and two large-diameter end portions 79*b*. Outer portions 79*a* are dimensioned to engage with either the upper surface 29*a* or the lower surface 29*b*of monorail 29, and end portions 79*b* are dimensioned to engage with either the vertical left surface 29*c* or the vertical right surface 29*d* of monorail 29. Thus, two of rollers 79 (one positioned at the forward end of carriage 33; the other positioned at the rear end of carriage 33) will roll along the upper surface 29*a* of monorail 29 (with end portions 79*b* guided by left and right surface 29*c* and 29*d*) and the other two of rollers 79 (one positioned at the forward end of carriage 33; the other positioned at the rear end of carriage 33) will roll along the lower surface 29*b* of monorail 29 (with end portions 79*b* guided by left and right surfaces 29*c* and 29*d*), allowing carriage 33 to translate along monorail 29 with excellent stability.

Stirrup tubes 39 are perforated in the same manner as front stanchion tube 1 is perforated, so that tubes 39 may be attached to stirrup sleeves 35 by pins 59 in any of a number of different positions.

Carriage interchange tube 43 may be positioned through tube brackets 41, and locked in place by quick release assemblies 11. To convert the inventive apparatus to a ski simulation device, after tube 43 is pushed through one of brackets 41, tube 43 is also pushed through seat bracket 42 (of the bicycle seat assembly including bicycle-type seat 45 and bracket 42) and through thigh pad bracket 44 (of the thigh pad assembly including thigh pads 46 and bracket 44). Tube 43 is then pushed through the other one of brackets 41, and all brackets are locked with tube 43 by tightening quick release assemblies 11.

Optionally, weight bracket 73 (of the weight assembly comprising bracket 73 and weight bar 75) may be positioned around tube 43 and locked in place by tightening the quick release assembly 11 attached to bracket 73. Weights 77 may be positioned along weight bar 75. The weight assembly may be attached around tube 43 whether or not the bicycle seat assembly and the thigh pad assembly are attached around tube 43.

FIG. 10 shows a swim bench assembly, including swim bench 83 and two bench brackets 85. The FIG. 10 swim bench assembly may be substituted for the bicycle seat assembly and thigh pad assembly shown in FIG. 8, by passing tube 43 through brackets 85 and tightening quick release assemblies to lock brackets 85 to tube 43.

FIG. 11 shows a variation of the FIG. 1 embodiment in which the FIG. 10 swim bench assembly is substituted for the bicycle seat assembly and thigh pad assembly shown in FIG. 1 (and in FIG. 8). The FIG. 11 embodiment also differs from that of FIG. 1 in that a paddle 91 is attached to the free end of each of pull straps 31 and 32. Paddles 91 may be releasably attached to pull straps 31 and 32 by any convenient means.

Bench 83 is padded, so that user 2 may comfortably lie on it while pulling on paddles 91 to translate carriage 33 along monorail 29. In this manner, the FIG. 11 apparatus allows the user to perform a simulated swimming exercise To readily convert the FIG. 11 apparatus back to its FIG. 1/FIG. 8 configuration, brackets 41 and 85 are released from tube 43, paddles 91 are removed from straps 31 and 32, and tube 43 with the bicycle seat assembly and thigh pad assembly mounted thereon is reattached to tube 43 in the manner described with reference to FIG. 8.

The foregoing is merely illustrative and explanatory of the inventive apparatus. Various changes in the component sizes and shapes, and other details of the embodiments described herein may be within the scope of the appended claims.

I claim:

1. An exercise apparatus, including:

a front stanchion assembly including a tube,
a pull strap assembly having a sleeve portion which is releasably mounted on the tube, and
a pair of pull straps, each of the pull straps having one end attached to the pull strap assembly;
a rear stanchion assembly;
a monorail having a first end and a second end, wherein the first end is attached to the front stanchion assembly and the second end is attached to the rear stanchion assembly, with the first end higher than the second end; and
as roller carriage assembly mounted on the monorail, said roller carriage assembly including a frame having a central orifice for receiving the monorail, spool-shaped rollers attached to the frame and extending into the frame's central orifice, a pair of tube mounting brackets attached to an upper external face of said frame, and an interchange tube received by and extending through the tube mounting brackets, whereby said interchange tube and tube mounting brackets are adapted to permit the attachment and detachment of user support assemblies.

2. The apparatus of claim 1, also including a crossbar having a first end, a second end, and a central portion, wherein the central portion of the crossbar is attached to the sleeve portion of the pull strap assembly, and wherein one of the pull straps is attached to each end of the crossbar.

3. The apparatus of claim 1, also including:
a first monorail connection assembly releasably attached to the front stanchion assembly and having a first sleeve portion releasably attached to the first end of the monorail; and
a second monorail connection assembly attached to the rear stanchion assembly and having a sleeve portion releasably attached to the second end of the monorail.

4. The apparatus of claim 1, wherein the front stanchion assembly includes a front stanchion tube, and wherein the first monorail connection assembly includes a second sleeve portion adapted to be releasably attached to the front stanchion tube.

5. The apparatus of claim 4, wherein the front stanchion tube has a longitudinal axis, the front stanchion tube has a plurality of tube holes spaced along the longitudinal axis, the second sleeve portion of the first monorail connection assembly has a first sleeve hole extending therethrough, and wherein the second sleeve portion is dimensioned to be translated relative to the front stanchion tube longitudinal axis in order to align the first sleeve hole with a first selected one of the tube holes, and also including:
a pin extending through the first sleeve hole and the first selected tube hole, for releasably connecting the second sleeve portion of the first monorail connection assembly to the front stanchion tube.

6. The apparatus of claim 5, wherein the second sleeve portion of the first monorail connection assembly has a second sleeve hole extending therethrough, and also including:
a quick release assembly mounted in the second sleeve hole, for releasably connecting the second sleeve portion of the first monorail connection assembly to the front stanchion tube when the first sleeve hole is aligned with the first selected tube hole.

7. The apparatus of claim 1 wherein oe of said user support assemblies comprises:
a bicycle seat assembly having a seat bracket; and
a thigh pad assembly having a thigh pad bracket, wherein the roller carriage assembly interchange tube extends through the bicycle seat bracket and the thigh pad bracket to rigidly secure the bicycle seat and thigh pad assemblies to the roller carriage assembly.

8. The apparatus of claim 7, also including:
a stirrup sleeve assembly attached to the frame of the roller carriage assembly; and
a stirrup assembly releasably attached to the stirrup sleeve assembly.

9. The apparatus of claim 8, wherein the stirrup sleeve assembly includes a pair of stirrup sleeves, and wherein the stirrup assembly includes:
a pair of stirrup tubes dimensioned to fit loosely within the stirrup sleeves; and
means for releasably attaching each stirrup sleeve to one of the stirrup tubes.

10. The apparatus of claim 1, also including:
a swim bench assembly having a bench bracket, and wherein the interchange tube extends through the bench bracket.

11. The apparatus of claim 10, wherein the front stanchion assembly includes a tube and a pull strap assembly having a sleeve portion, and wherein the sleeve portion is releasably mounted on the tube, and also including:
a pair of pull straps, each of the pull straps having a first end attached to the pull strap assembly and a second end; and
a pair of swim paddles, wherein each of the swim paddles is attached to the second end of one of the pull straps.

12. The apparatus of claim 1, also including:
a weight assembly having a weight bracket, wherein the roller carriage assembly interchange tube extends through the weight bracket to rigidly secure the weight assembly to the roller carriage assembly.

13. The apparatus of claim 1, wherein the front stanchion assembly is inclined at a first acute angle with respect to a horizontal plane, and the rear stanchion assembly is inclined at a second acute angle with respect to a horizontal plane.

14. The apparatus of claim 13, wherein said front stanchion assembly is inclined at an angle substantially equal to 70 degrees with respect to a horizontal plane.

15. The apparatus of claim 1, also including:
a front pulley attached to the front stanchion assembly;
a rear pulley assembly, including at least one rear pulley attached to the rear stanchion assembly;
a cable having a first end attached to the frame of the roller carriage assembly, wherein the cable extends through the front pulley and through each said rear pulley.

16. The apparatus of claim 15, wherein the cable has a second end, and also including:
an ankle attached to the cable's second end, wherein a user may perform exercises by pulling the ankle strap away from the rear pulley assembly so as to cause the cable to pull the roller carriage assembly along the monorail toward the front pulley.

17. The apparatus of claim 15, wherein the cable has a second end, and also including:

an handle bar attached to the cable's second end, wherein a user may perform exercises by pulling the handle bar away from the rear pulley assembly so as to cause the cable to pull the roller carriage assembly along the monorail toward the front pulley.

18. The apparatus of claim 1, wherein the front stanchion assembly includes a tube, and also including:

a pull-up bar assembly having a pull-bar bar sleeve, wherein the pull-up bar sleeve is releasably attached to the tube.

19. The assembly of claim 1, wherein said monorail has a rectangular cross-section and includes an upper surface, a lower surface, and a pair of vertical surfaces, and a first one of the spool-shaped rollers has a first roller portion which rolls on the monorail's upper surface, and a pair of outer roller portions guided by the monorail's vertical surfaces.

20. The assembly of claim 19, wherein a second one of the spool-shaped rollers includes:

a first roller portion which rolls along the monorail's lower surface; and a pair of outer roller portions guided by the monorail's vertical surfaces.

21. An exercise apparatus, including:

a front stanchion assembly;

a rear stanchion assembly;

a monorail having a first end and a second end, wherein the first end is attached to the front stanchion assembly and the second end is attached to the rear stanchion assembly, and wherein the monorail inclines upward toward the front stanchion assembly;

a gripping means attached to the front stanchion assembly said gripping means comprising a pair of pull straps, each having an end attached to the front stanchion assembly; and a roller carriage assembly mounted around the monorail and capable of rolling along the monorail, said roller carriage assembly including a frame and a mounting assembly for releasably mounting one or more modular interchangeable user support assemblies on the roller carriage assembly, said mounting assembly comprising a pair of tube mounting brackets attached to the frame; and an interchange tube extending through the tube mounting brackets wherein a user supported on the roller carriage assembly may pull on the gripping means to cause the roller carriage assembly to roll up the monorail toward the front stanchion assembly.

22. The apparatus of claim 21, wherein one of said modular user support assemblies comprises:

a bicycle seat; and a seat bracket attached to the bicycle seat, wherein the interchange tube extends through the seat bracket, and wherein the mounting assembly includes means for releasably locking the seat bracket to the interchange tube.

23. The apparatus of claim 21, wherein one of said modular user support assemblies comprises;

a swim paddle attached to the second end of each pull strap;

a swim bench;

a bench bracket attached to the swim bench, wherein the interchange tube extends through the bench bracket, and wherein the mounting assembly includes means for releasably locking the bench bracket to the interchange tube.

24. The apparatus of claim 21, wherein the front stanchion assembly is inclined at a first acute angle with respect to a horizontal plane, and the rear stanchion assembly is inclined at a second acute angle with respect to a horizontal plane.

25. The apparatus of claim 24, wherein the front stanchion assembly is inclined at an angle substantially equal to 70 degrees with respect to a horizontal plane.

* * * * *